US007399000B2

(12) United States Patent
Lee

(10) Patent No.: US 7,399,000 B2
(45) Date of Patent: Jul. 15, 2008

(54) HOSE LOCK APPARATUS FOR VACUUM CLEANER

(75) Inventor: Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/896,855

(22) Filed: Jul. 23, 2004

(65) Prior Publication Data

US 2005/0140137 A1 Jun. 30, 2005

(30) Foreign Application Priority Data

Dec. 31, 2003 (KR) ..... 10-2003-0101478

(51) Int. Cl.
*A47L 9/24* (2006.01)

(52) U.S. Cl. ..... 285/7; 285/402

(58) Field of Classification Search ..... 285/7, 285/81, 396, 360, 361, 401, 402; 15/377, 15/327.1, 327.6, 327.7
See application file for complete search history.

(56) References Cited

U.S. PATENT DOCUMENTS

| | | | | |
|---|---|---|---|---|
| 1,415,053 | A | 5/1922 | Robertson | |
| 1,829,255 | A | 10/1931 | Ballou | |
| 2,241,773 | A | 5/1941 | Oskar | |
| 2,280,350 | A | 4/1942 | Pardee | |
| 3,083,041 | A | 3/1963 | Stanley | |
| 3,306,634 | A | 2/1967 | Groves | |
| 3,309,113 | A | 3/1967 | Beach | |
| 3,375,541 | A | 4/1968 | Fromknecht | |
| 3,381,328 | A | 5/1968 | Szabo | |
| 3,674,287 | A | 7/1972 | Selley | |
| 3,869,751 | A | 3/1975 | Boyd et al. | |
| 4,017,937 | A * | 4/1977 | Hanold | 15/327.1 |
| 4,174,858 | A * | 11/1979 | Brooks | 285/7 |
| 4,449,737 | A * | 5/1984 | Specht | 285/7 |
| 4,758,023 | A * | 7/1988 | Vermillion | 285/7 |

(Continued)

FOREIGN PATENT DOCUMENTS

| | | |
|---|---|---|
| EP | 0 634 601 | 7/1994 |

(Continued)

OTHER PUBLICATIONS

Combined Search and Examination Report from Great Britain Patent Office dated Jan. 21, 2005.

*Primary Examiner*—Aaron M Dunwoody
(74) *Attorney, Agent, or Firm*—Blank Rome LLP

(57) ABSTRACT

A hose lock apparatus for a vacuum clean that provides easy attachment and detachment of a hose to and from an air inlet of the vacuum cleaner body, is disclosed. The hose lock apparatus includes a hose clamp in a form of a hollow cylinder and engaged with an end of the hose therein. The hose clamp further includes a locking protrusion along an outer circumference. The hose lock apparatus includes an air inlet portion which is configured at the vacuum-cleaner body to receive an end of the hose clamp. The air inlet portion includes an insertion hole for guiding the locking protrusion towards an inserting direction, and a seating groove connected to the insertion hole to receive the locking protrusion when the hose clamp is rotated by a predetermined number of degrees. When the hose clamp is attached to the air inlet, a cleaning work with the hose is enabled.

10 Claims, 7 Drawing Sheets

U.S. PATENT DOCUMENTS

| | | | | |
|---|---|---|---|---|
| 4,877,432 | A | 10/1989 | Lackner | |
| 5,072,971 | A * | 12/1991 | Roman | 285/402 |
| 5,247,719 | A | 9/1993 | Wareham et al. | |
| 5,464,460 | A | 11/1995 | Bosses | |
| 5,727,739 | A * | 3/1998 | Hamilton | 285/361 |
| 6,279,968 | B1 * | 8/2001 | Stoll et al. | 285/360 |
| 6,398,128 | B1 * | 6/2002 | Hamilton et al. | 239/71 |
| 2003/0132634 | A1 | 7/2003 | Biere et al. | |
| 2005/0140136 | A1 | 6/2005 | Lee | |

FOREIGN PATENT DOCUMENTS

| | | |
|---|---|---|
| FR | 2 659 219 | 3/1991 |
| FR | 2659219 | 9/1991 |
| GB | 454969 | 10/1936 |
| GB | 488415 | 7/1938 |
| GB | 858370 | 1/1961 |
| GB | 1479626 | 7/1977 |
| GB | 2119046 | 11/1983 |
| KR | 20-1989-0012608 | 8/1989 |

* cited by examiner

HOSE LOCK APPARATUS FOR VACUUM CLEANER

REFERENCE TO RELATED APPLICATION

This application claims priority to copending Korean Patent Application No. 2003-101478 filed on Dec. 31, 2003, in the Korean Intellectual Property Office.

CROSS-REFERENCE TO RELATED APPLICATION

This application is related to the copending application entitled, "Hose Lock Apparatus for Vacuum Cleaner," (Korean Application 2003-100431, filed Dec. 30, 2003), which disclosure is commonly owned by the same assignee as the present application and is entirely incorporated herein by reference.

FIELD OF THE INVENTION

The present invention relates to a hose lock apparatus for a vacuum cleaner, and more particularly to a hose lock apparatus for a vacuum cleaner that provides easy attachment and detachment of the hose to/from the vacuum cleaner body.

BACKGROUND OF THE INVENTION

A typical vacuum cleaner creates a partial vacuum by rotating an impeller in its body and entraining air. The vacuum cleaner includes a flexible hose connected to its body to provide a passage for air and dust from select areas. Particularly, an upright-type vacuum cleaner, which is one variant type of vacuum cleaners, generally has a hose at an air inlet at the rear portion of the body which is connected to an auxiliary brush to conveniently clean crevices such as stairs or corners of the room.

FIG. 1 is a view illustrating an example of the upright-type vacuum cleaner with a hose for the auxiliary suction brush at the rear end of the body. FIG. 2 is a view illustrating a hose lock apparatus for vacuum cleaners according to the conventional art for locking the hose to the air inlet of the vacuum cleaner body.

The hose lock apparatus 10 for conventional vacuum cleaners includes a hose clamp 12 locked at an end of a hose 3, a clamp holder 14 secured at the vacuum cleaner body 1, and a clamp connector 16 fixing the hose clamp 12 to prevent separation from the clamp holder 14. The hose clamp 12 is configured in the form of an angular pipe of 90 degrees and includes the hose 3 locked at an end. The other end of the hose clamp 12 is inserted in the clamp holder 14, configured to connect to the air inlet provided at the vacuum cleaner body, and has a locking means to lock the clamp connector 16 at the outer side.

The clamp holder 14 includes a hole 15 in the middle to receive the other end of the hose clamp 12, and two locking holes around the hole 15. The clamp holder 14 is attached to the vacuum cleaner body 1 by connecting two screws 18 through two locking holes. The clamp connector 16 locks the hose clamp 12 to prevent separation from the clamp holder 14, and is locked at the hose clamp 12 by the lock apparatus at the other end of the hose clamp 12.

The process for attaching the hose lock apparatus 10 with the above construction to the vacuum cleaner body 1 is described below.

First, the hose 3 is engaged to one end of the hose clamp 12. The clamp holder 14 is inserted into the other end of the hose clamp 12, and the clamp connecter 16 is fitted over the other end of the hose clamp 12, thereby locking the clamp holder 14 in the hose clamp 12. The clamp holder 14 is attached to the vacuum cleaner body 1 by inserting two screws 18 into the locking hole of the clamp holder 14, and inserting the other end of the hose clamp 12 into the air inlet provided at the vacuum cleaner body 1. Since the hose clamp 12 is locked in an end of the hose 3 and is not separable from the clamp holder 14, the hose 3 can be securely locked with the air vacuum cleaner body 1. Furthermore, a cleaning work using hose 3 can be done through the hose 3 connected in the air inlet of the vacuum cleaner body 1 by the hose clamp 12.

As described above, a conventional air vacuum cleaner cleans with the hose 3 by attaching the hose 3 to the vacuum cleaner body 1 via the hose lock apparatus 10.

Since the hose lock apparatus 10 requires a user to lock the clamp holder 14 in the hose clamp 12, and securing the clamp holder 14 with two screws 18 to the air vacuum cleaner body 1, it is inconvenient for the user to assemble the hose 3 to the air vacuum cleaner body 1. In addition, when the hose 3 is blocked by foreign substances, the two screws 18 must be unscrewed, the clamp holder 14 has to be disassembled, and the hose 3 is separated from the vacuum cleaner body 1 to remove the foreign substances from the hose 3. Thus, it is inconvenient to remove the foreign substances. Particularly, production cost of the hose lock apparatus for vacuum cleaners according to the conventional art is relatively high because the hose lock apparatus requires three discrete parts 12, 14 and 16.

Thus, a heretofore unaddressed need exists in the industry to address the aforementioned deficiencies and inadequacies.

SUMMARY OF THE INVENTION

The present invention solves the above-mentioned problems occurring in the prior art, wherein an object of the present invention is to provide a hose lock apparatus for a vacuum cleaner that a user can easily attach a hose to a vacuum cleaner body without requiring screws, and separate the hose from the vacuum cleaner body with convenience as the need arises such as in the removal of foreign substances from a blocked hose, and thus, improving the use and convenience of using a vacuum cleaner. Another object of the present invention is to provide a hose lock apparatus for a vacuum cleaner that requires a lesser number of necessary parts and is inexpensive in production cost.

In order to achieve the above aspects, a hose lock apparatus is provided for vacuum cleaners that locks a hose for drawing in dust to the vacuum cleaner body. The hose lock apparatus includes a hose clamp that is in the form of a hollow cylinder and is engaged with an end of the hose therein. The hose lock apparatus includes a locking protrusion along the outer circumference and an air inlet portion that is configured at the vacuum cleaner body to receive the end of the hose clamp. The air inlet portion includes an insertion hole for guiding the locking protrusion to insertion and, a seating groove connected to the insertion hole to receive the locking protrusion when the hose clamp is rotated by a predetermined degrees. Thus, when the hose clamp is attached to the air inlet a cleaning work with the hose is enabled.

The locking rib may be configured at the outside of the hose clamp wherein a guiding groove corresponding to the locking rib is configured at the inside of the air inlet. The locking groove may be configured at the locking rib on the inside of the air inlet when the hose clamp is rotated by predetermined degrees. The edges of the locking protrusion of the hose clamp, and the seating groove of the contacting air inlet when the hose clamp inserted in the air inlet is rotated by predetermined degrees, may be chamfered. The edges of the locking protrusion of the hose clamp may be chamfered. The edge of an entrance part of the air inlet may be chamfered.

As described above, with the hose lock apparatus for a vacuum cleaner according to an embodiment of the present invention, a user can easily attach the hose to the vacuum cleaner body. Inserting the hose clamp into the air inlet of the vacuum cleaner body and then rotating the hose clamp by predetermined degrees are all that are needed to lock the hose to the vacuum cleaner body. In addition, when it is necessary to separate a hose from the vacuum cleaner body to remove dust from the hose, the hose can be separated from the body simply by rotating the hose clamp by the predetermined degrees in the opposite direction. Therefore, it is convenient to detach the hose from the vacuum cleaner body, and, convenience of using a vacuum cleaner is increased. Since only a clamp is necessary to lock the hose to a vacuum cleaner body, product cost can be decreased.

Other systems, methods, features, and advantages of the present invention will be or became apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The above and other aspects, features and advantages of the present invention will be more apparent from the following detailed description taken with reference to the accompanying drawings. The components in the drawings are not necessarily to seal, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

Figure 1:
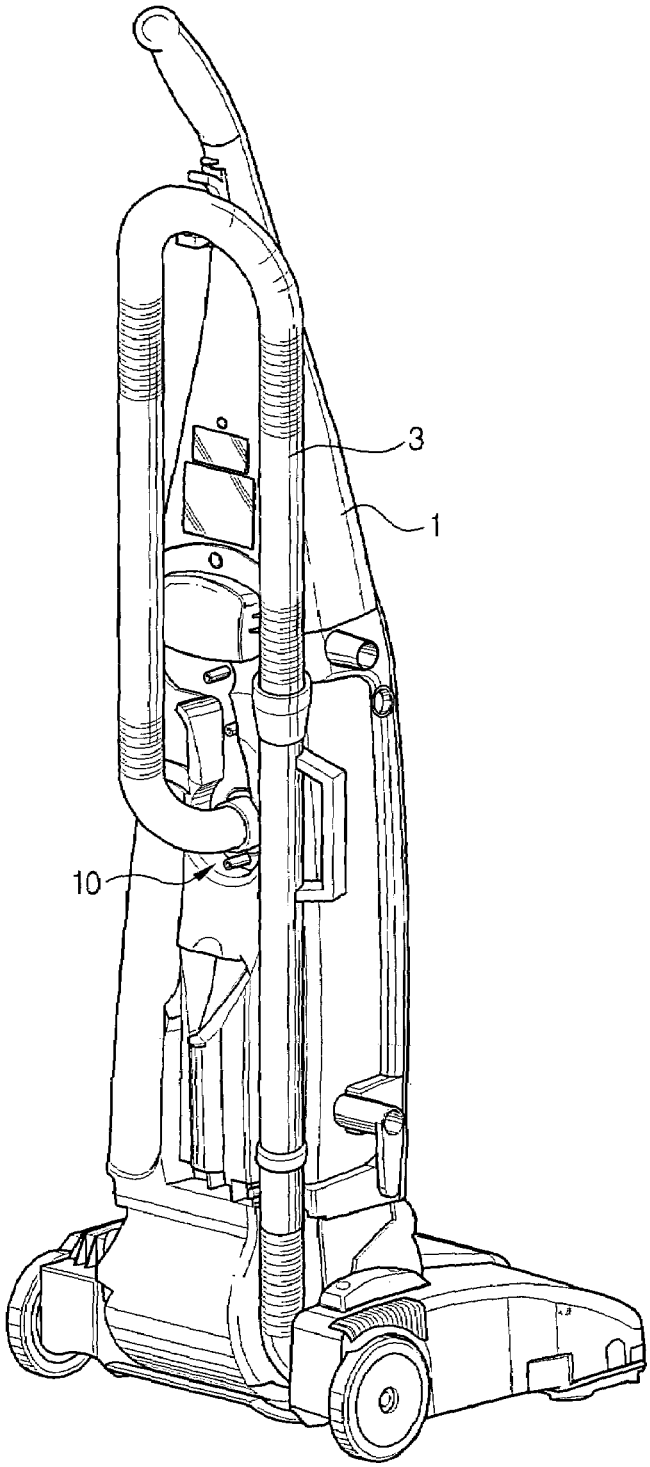
FIG. 1 (PRIOR ART)
FIG. 1 is a drawing of a perspective view showing a upright-type vacuum cleaner in which a hose is secured by a conventional hose lock apparatus.
Figure 2:
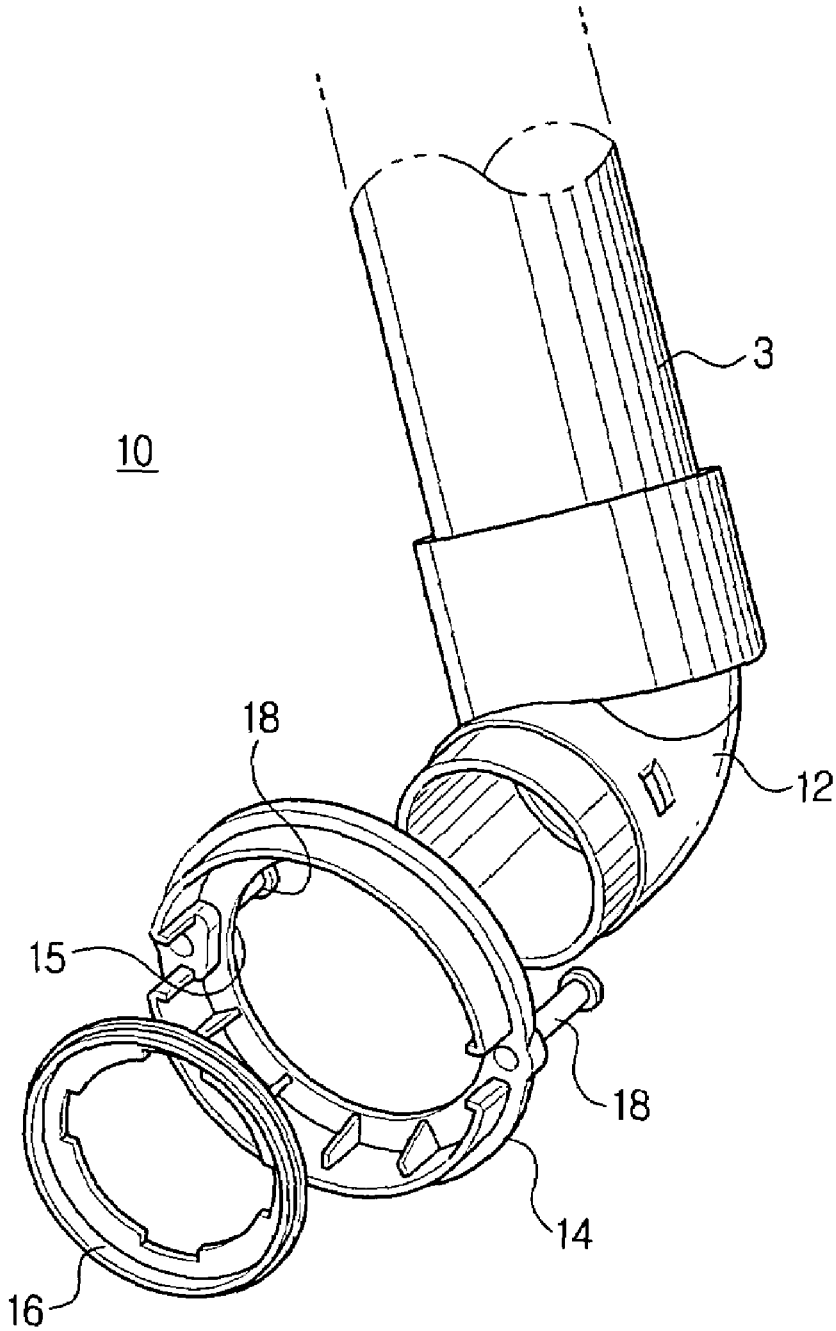
FIG. 2 (PRIOR ART)
FIG. 2 is a drawing of an exploded perspective view showing an example of the hose lock apparatus for the vacuum cleaner shown in FIG. 1.
Figure 3:
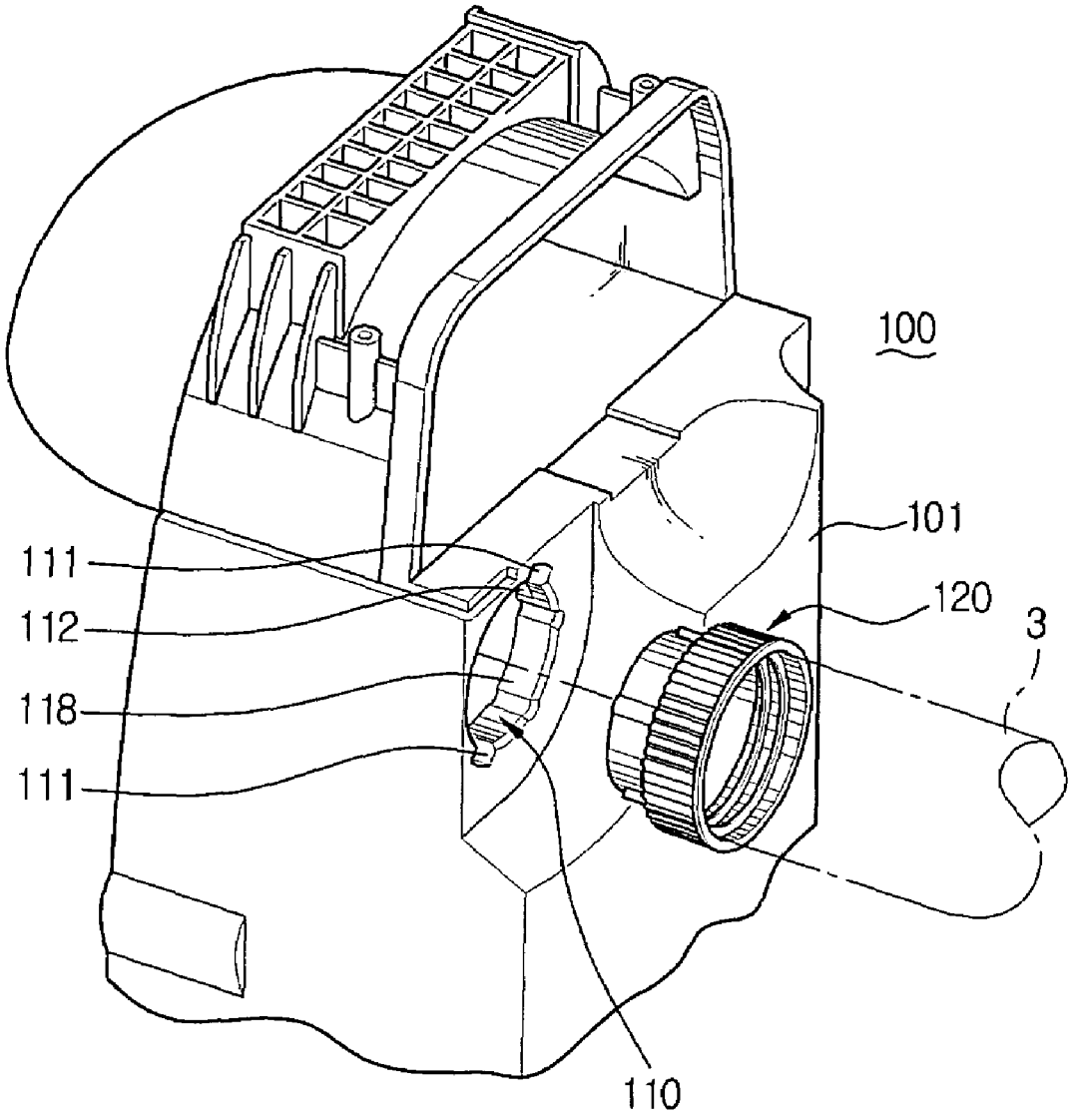
FIG. 3 is a drawing of an exploded perspective view showing a hose lock apparatus for the vacuum cleaner according to an embodiment of the present invention.
Figure 4:
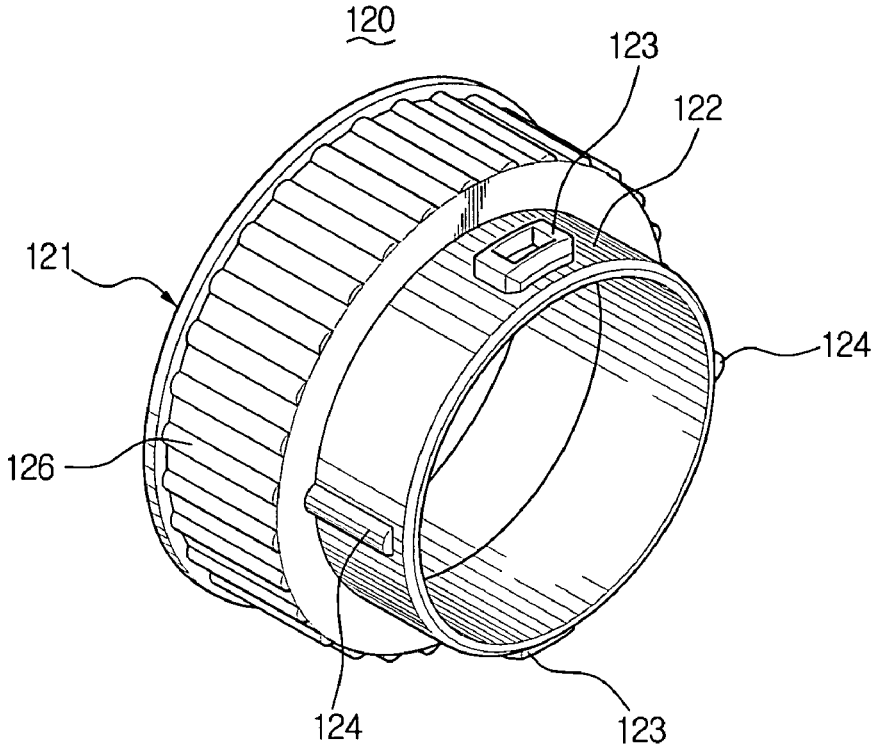
FIG. 4 is a drawing of a perspective view showing a hose clamp of the hose lock apparatus shown in FIG. 3.

FIG. 3 is an exploded perspective view showing an embodiment of the hose lock apparatus for vacuum cleaners according to an embodiment of the present invention, and FIG. 4 is a perspective view showing a hose clamp. The hose lock apparatus 100 includes a hose clamp 120 secured at an end of the hose 3, and an air inlet 110 configured at the vacuum cleaner body 101. The hose clamp 120 may be configured as a hollow cylinder, with one end securely receiving one end of the hose therein, and a protrusion 123 on the outer circumference of the other end. In one embodiment, the hose clamp 120 may be configured as a dual-structured cylinder as shown in FIG. 4. The inside of the large-diameter cylinder 121 is fitted with an end of the hose 3. The small-diameter cylinder 122 has a diameter corresponding to that of the air inlet 110, and the protrusion 123 corresponding to an insertion hole 111 of the air inlet 110 configured at the outside. The diameter of the cylinder 121 is preferably sized to cover the air inlet 110 when the hose clamp 120 is assembled to the air inlet 110. The outside of the bigger cylinder 121 is preferably formed by knurling, or configured as knurls 126, for ease in attachment and detachment of the hose clamp 120 with respect to the air inlet 110. The hose 3 can be secured by several methods; by using adhesives at the inside of the cylinder 121 of the hose clamp 120, or by configuring female screws at the inside of the cylinder 121 of the hose clamp 120 and male screws at the end of the hose 3 and connecting the screws.

Figure 5:
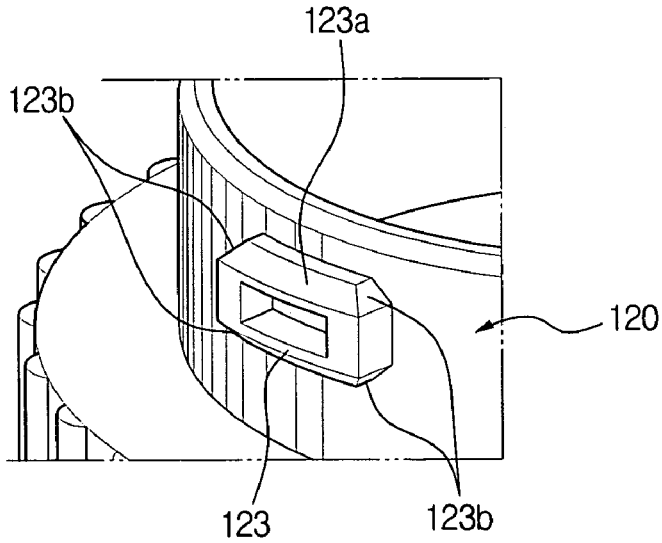
FIG. 5 is a drawing of a fragmentary perspective view showing a chamfered portion of the hose clamp shown in FIG. 4.

The locking protrusion 123 of the hose clamp 120 locks the hose clamp 120 to prevent separation from the air inlet 110 and is formed corresponding to the insertion hole 111 of the air inlet 110. An edge 123*a* (FIG. 5) of the locking protrusion 123 at the side inserted in the insertion hole 111 of the air inlet 110 is preferably chamfered for ease in inserting the hose clamp 120. The edge 123*b* (FIG. 5) of the locking protrusion 123 at the side inserted in the seating groove 112 of the air inlet 110 is also preferably chamfered so that the hose clamp 120 that is inserted in the air inlet 110 can be easily rotated by a number of predetermined degrees. Only one of the locking protrusion 123 of the hose clamp 120 is configured, however, at least two of the locking protrusions are preferred. According to the present embodiment, two locking protrusions 123 are configured at intervals of 180 degrees.

The hose clamp 120 may further include a locking rib 124 for securing the hose clamp 120 to prevent separation from the air inlet 110 by a force pressed on the hose clamp 120 when a user cleans with the hose 3. The locking rib 124 is configured at the outside of the small-diameter cylinder 122 with the locking protrusion 123 as shown FIG. 4, and is formed such that the user can rotate, by a predetermined number of degrees, the hose clamp 120 in the air inlet 110. Accordingly, the locking rib 124 includes a substantially circular arc section. Only one of the locking rib 124 of the hose clamp 120 is configured, although at least two are preferred. When two locking protrusions 123 are provided to the hose clamp 120 as in the present embodiment, the two locking ribs 124 are preferably configured between the two locking protrusions 123.

The air inlet 110 is configured at the vacuum cleaner body 101 and connects to an air suction tube (not shown) which is connected to an impeller (not shown) provided at the inside of the vacuum cleaner body 101. The air inlet 110 includes side walls 118 of predetermined length at the inside of the body 101 as shown FIG. 3. An insertion hole 111 that guides a locking protrusion 123 of the hose clamp 120, and a seating groove 112 that locks the locking protrusion 123 to prevent separation from the air inlet 110, are formed from the side walls 118 (refer to FIG. 6 and 7A). Axially-spaced inserting holes 111 are configured corresponding to the shapes and numbers of the locking protrusions 123 of the hose clamp 120. The seating groove 112 is connected to the lower part of the inserting hole 111, is formed circumferentially along the side walls 118 of the air inlet 120, and is formed corresponding to the locking protrusion 123 to prevent separation of the hose clamp 120 from the inserting direction. Accordingly, the locking protrusion 123 is received in the seating groove 112 by fitting the locking protrusion 123 to the insertion hole 111, inserting the hose clamp 120 into the insertion hole 111 and rotating the clamp by a predetermined number of degrees toward the seating groove 112. Thus, the hose clamp 120 does not separate from the air inlet 110. The seating groove 112 of the air inlet 110 is sized preferably so that the locking protrusion 123 of the hose clamp 120 is received in the seating groove 112 when the hose clamp 120 is rotated approximately 30 degrees (refer to FIG. 7C).

Figure 7A:
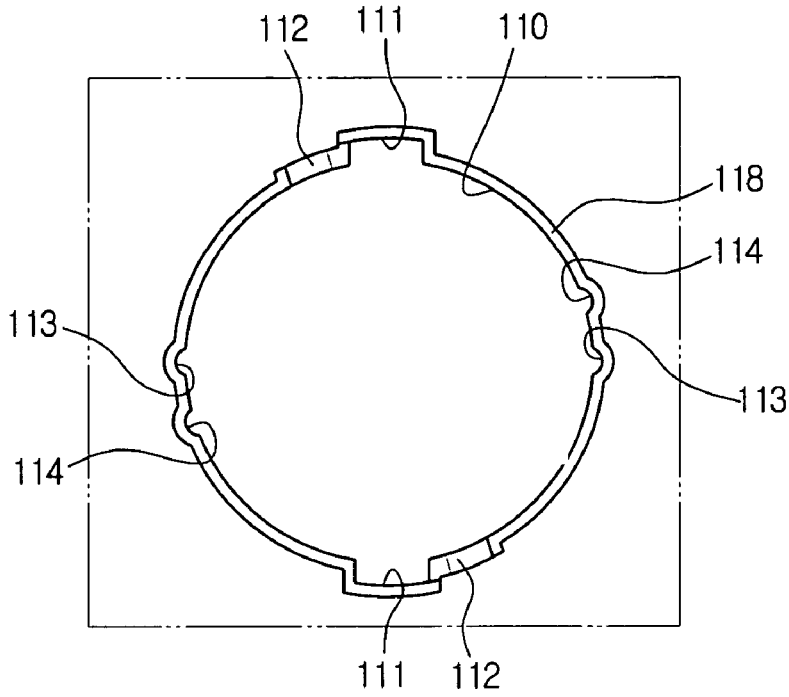
FIG. 7A is a drawing of a rear view of the air inlet of the vacuum cleaner.

When locking ribs 124, are configured at the hose clamp 120, the guiding groove 113 corresponding to the locking rib 124 is provided at the side walls 118 of the air inlet 110 for easy insertion of the hose clamp 120 into the air inlet 110, as shown in FIG. 7A. The guiding groove 113 is configured at the side wall 118 of the air inlet 110 at the side in contact with the locking rib 124 when the locking protrusion 123 is inserted in the inserting hole 111. When the hose clamp 120 is rotated by a predetermined number of degrees and is received in the seating groove 112, the locking groove 114 is provided preferably at the side wall 118 of the air inlet 110 to be received by the locking rib 124 and to prevent the hose clamp 120 from rotating. When the hose clamp 120 is rotated approximately 30 degrees and the locking protrusion 123 is received in the seating groove 112, the locking groove 114 is configured 30 degrees apart from the guiding groove 113. The quantities of the guiding groove 113 and the locking groove 114 are determined by the quantity of the locking rib 124 of the hose clamp 120. Accordingly, when there are two locking ribs 124, the guiding groove 113 and the locking groove 114 of the air inlet 110 are also configured as two, respectively.

Figure 6:
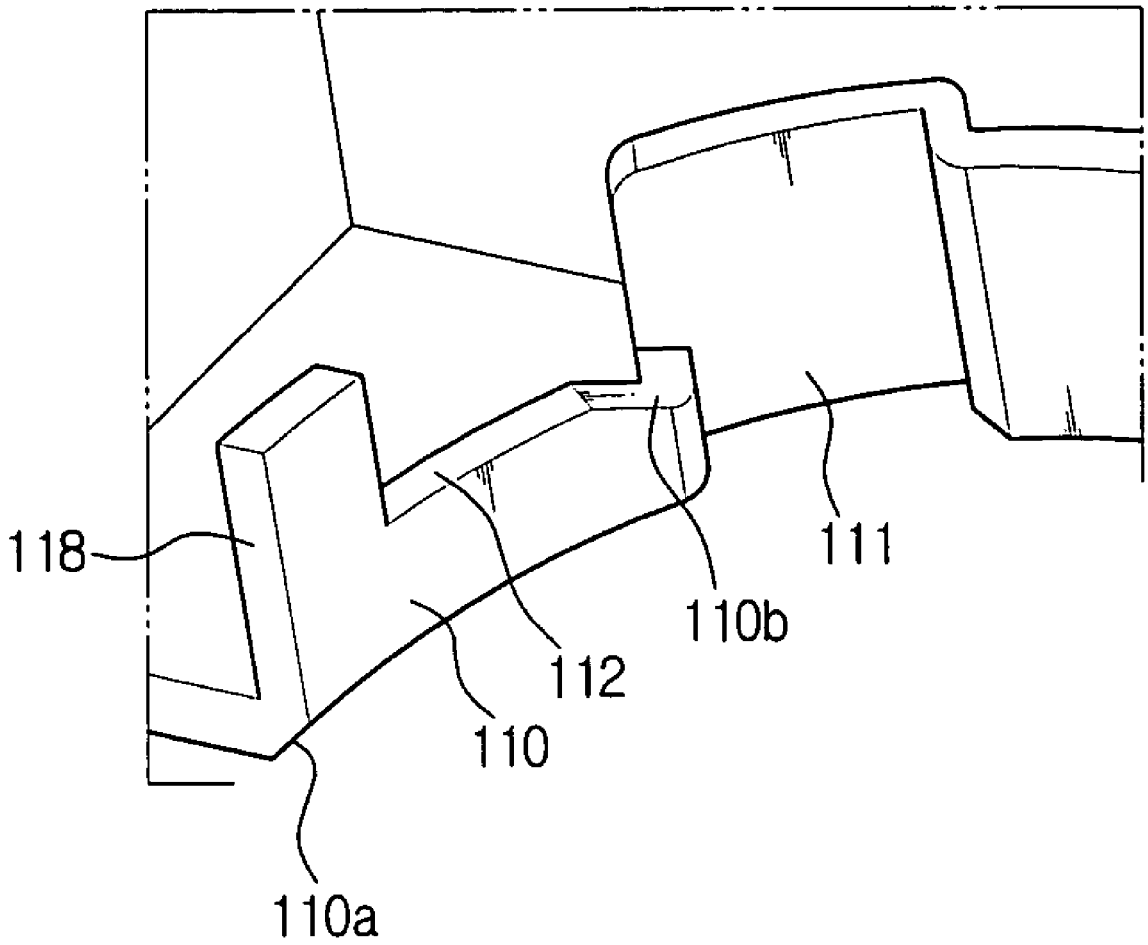
FIG. 6 is a drawing of a fragmentary perspective view showing a chamfered portion at the air inlet of the vacuum cleaner shown in FIG. 3.

When the hose clamp 120 is inserted in the entrance part 110A (FIG. 6) of the air inlet 110, the entrance part is chamfered preferably to prevent interference, as shown in FIG. 6. Specifically, when the hose clamp 120 is rotated in the air inlet 110, the entrance edge 10B of the seating groove 112 is also chamfered so the seating groove 112 does not interfere with the locking groove 123.

Hereinafter, operation of the hose lock apparatus of vacuum cleaners according to the present invention will be described in detail with reference to the accompanying drawings.

Figure 7B:
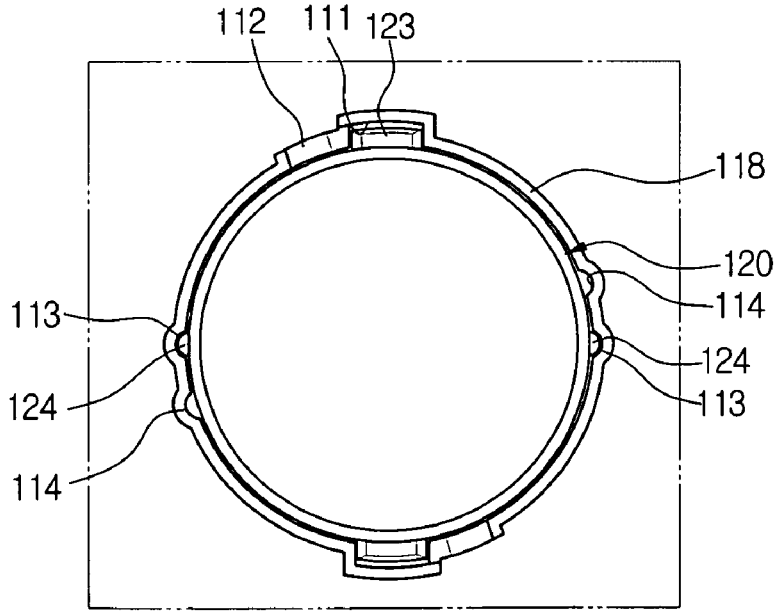
FIG. 7B is a drawing of a rear view showing a hose clamp inserted in the air inlet.
Figure 7C:
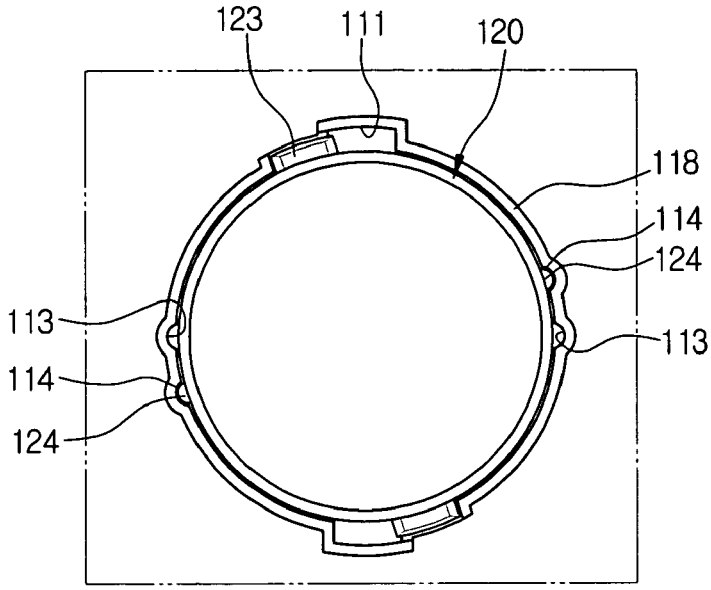
FIG. 7C is a drawing of a rear view showing a hose clamp rotated by predetermined degrees and then locked in the air inlet.
Figure 8:
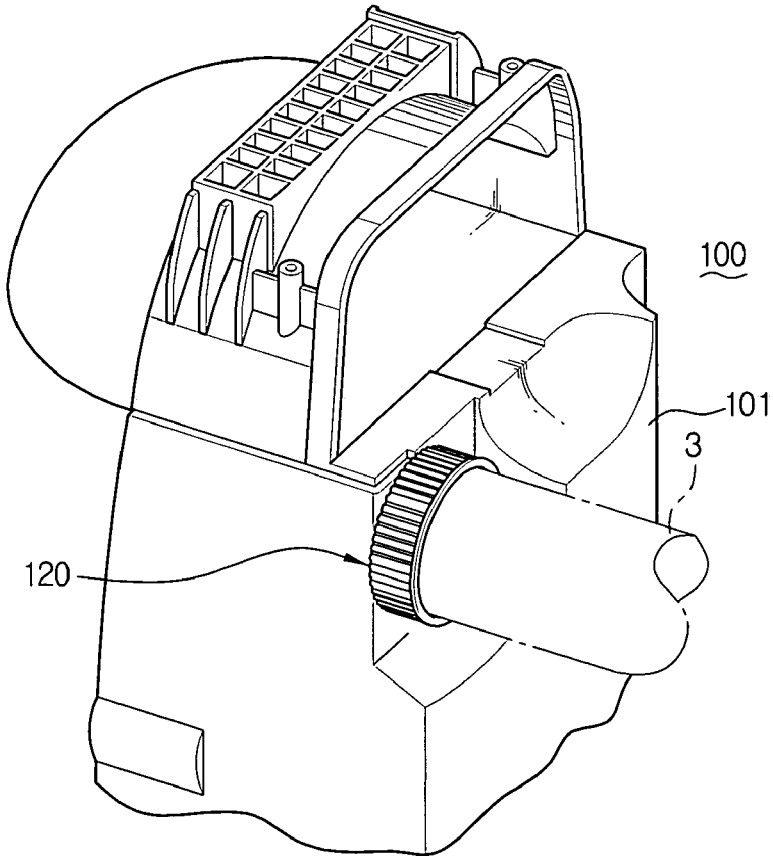
FIG. 8 is a drawing of a perspective view showing a hose clamp attached to the air inlet of the hose lock apparatus for a vacuum cleaner shown in FIG. 3.

The hose clamp 120 is locked at an end of the hose 3. When a female screw is formed at the inside of the cylinder 121 with a larger diameter than the hose clamp 120, and a male screw is formed at the end of the hose 3, the hose clamp 120 is assembled to the end of the hose 3 by a screw coupling. The locking protrusion 123 of the hose clamp 120 is aligned with the insertion hole 111 of the air inlet 110, and the small-diameter cylinder 122 of the hose clamp 120 is urged into the air inlet 110. When the cylinder 121 with a diameter larger than the hose clamp 120 contacts the vacuum cleaner body 101 with the air inlet 110, the protrusion 123 of the hose clamp 120 is received in the seating groove 112 by rotating the hose clamp 120 toward a predetermined direction, clockwise, about 30 degrees. As a result, the hose 3 is locked to the vacuum cleaner body 101 as shown in FIG. 8. When the locking rib 124 is configured at the hose clamp 120 and the guiding groove 113 is provided at the air inlet 110, the locking protrusion 123 and locking rib 124 of the hose clamp 120 are aligned with the insertion hole 111. The guiding groove 113 and the hose clamp 120 are then inserted in the air inlet 110 (refer to FIG. 7B). When the cylinder 121 with a diameter larger than the hose clamp 120 contacts the vacuum cleaner body 101 having the air inlet 110, the protrusion 123 of the hose clamp 120 is received in the seating groove 112 by rotating the hose clamp 120 approximately 30 degrees (refer to FIG. 7C). Since the locking groove 114 is configured at the side wall 118 of the air inlet 110, the locking rib 124 of the hose clamp 120 is received in the locking groove 114. Therefore, the hose clamp 120 does not separate from the air inlet 110 by a force used by the user when the user grabs the hose for cleaning tasks.

When it is desired to separate the hose 3 from the air inlet 110 of the vacuum cleaner body 101, the hose 3 can be easily separated by rotating the hose clamp 120 in an opposite direction, counterclockwise, approximately 30 degrees, and then pulling the hose clamp 120 in an axial direction.

Additional advantages, objects, and features of the embodiments of the invention will be set forth in part in the description which follows, and in part, will become apparent to those having ordinary skill in the art upon examination of the following, or may be learned from practice of the invention. The objects and advantages of the embodiments of the invention may be realized and attained as particularly pointed out in the appended claims.

What is claimed is:

1. A hose lock apparatus for connecting an air suction hose of a vacuum cleaner to a vacuum cleaner body, comprising:

a vacuum cleaner hose clamp in a form of a hollow cylinder, engaged with an end of the air suction hose therein, and having at least one locking protrusion along an outer circumference and at least one locking rib on a surface of the hose clamp; and an air inlet configured at the vacuum cleaner body to receive an end of the hose clamp, the air inlet including, at least one insertion hole for receiving each locking protrusion in an inserting direction, at least one seating groove connected to the insertion hole to receive the at least one locking protrusion when the hose clamp is rotated by a predetermined angle such that engagement of the at least one locking protrusion and the at least one seating groove prevents removal of the hose clamp, at least one guiding groove extending along a surface of the air inlet in the inserting direction to receive the at least one locking rib as the hose clamp is inserted in the air inlet, and at least one locking groove spaced from the at least one guiding groove by the predetermined angle and engaging the at least one locking rib of the hose clamp in detent when the hose clamp is rotated by the predetermined angle, thus holding the hose clamp and the at least one locking protrusion in a lock position relative to the air inlet.

2. The hose lock apparatus according to claim 1, wherein there are two locking ribs, two guiding grooves, and two locking grooves.

3. The hose lock apparatus according to claim 1, wherein edges of the locking protrusion of the hose clamp and the seating groove of the air inlet in intimate contact when the hose clamp in the air inlet is rotated by the predetermined angle, are both chamfered.

4. The hose lock apparatus according to claim 3, wherein the edge of the locking protrusion of the hose clamp is chamfered where it contacts the air inlet when the hose clamp is inserted in the air inlet.

5. The hose lock apparatus according to claim 4, wherein an edge of an entrance part of the air inlet is chamfered where it contacts the hose clamp when the hose clamp is inserted in the air inlet.

6. The hose lock apparatus according to claim 1, wherein the hose clamp includes two locking protrusions.

7. The hose lock apparatus of claim 1, wherein the locking rib has a section corresponding to an arc.

8. The hose lock apparatus of claim 7 wherein the arc is substantially semicircular.

9. The hose lock apparatus of claim 8 wherein the locking rib extends longitudinally along a surface of the hose clamp and the arc section of the locking rib has a central longitudinal axis extending in the inserting direction.

10. The hose lock apparatus of claim 9 wherein the predetermined angle is approximately 30 degrees.

* * * * *